US011608674B2

(12) United States Patent
Fazio

(10) Patent No.: US 11,608,674 B2
(45) Date of Patent: Mar. 21, 2023

(54) SYSTEM AND METHOD FOR CONVERTING AN OVERHEAD DOOR INTO A GATE OR SERVING WINDOW TO FACILITATE ENTERTAINMENT AND OTHER PURPOSES

(71) Applicant: Testarossa Incorporated, Homer Glen, IL (US)

(72) Inventor: Stefano C. Fazio, Lemont, IL (US)

(73) Assignee: Testarossa Incorporated, Homer Glen, IL (US)

( * ) Notice: Subject to any disclaimer, the term of this patent is extended or adjusted under 35 U.S.C. 154(b) by 623 days.

(21) Appl. No.: 16/691,592

(22) Filed: Nov. 21, 2019

(65) Prior Publication Data

US 2020/0355023 A1 Nov. 12, 2020

Related U.S. Application Data

(60) Provisional application No. 62/911,921, filed on Oct. 7, 2019, provisional application No. 62/844,043, filed on May 6, 2019.

(51) Int. Cl.

| | |
|---|---|
| ***E06B 7/32*** | (2006.01) |
| ***E06B 3/48*** | (2006.01) |
| ***E05D 3/02*** | (2006.01) |
| ***E05B 65/00*** | (2006.01) |
| ***E05D 7/10*** | (2006.01) |
| ***G09F 17/00*** | (2006.01) |
| ***E06B 3/28*** | (2006.01) |
| ***E05F 1/08*** | (2006.01) |

(52) U.S. Cl.

CPC ..... *E06B 7/32* (2013.01); *E05B 65/0021* (2013.01); *E05D 3/02* (2013.01); *E05D 7/1044* (2013.01); *E05F 1/08* (2013.01); *E06B 3/28* (2013.01); *E06B 3/485* (2013.01); *G09F 17/00* (2013.01); *E05Y 2900/106* (2013.01); *E05Y 2900/132* (2013.01); *G09F 2017/0041* (2013.01)

(58) Field of Classification Search

None

See application file for complete search history.

(56) References Cited

U.S. PATENT DOCUMENTS

| | | | | |
|---|---|---|---|---|
| 4,537,237 A | | 8/1985 | Sepulveda | |
| 4,653,566 A | * | 3/1987 | Miale | E06B 9/52 160/113 |
| 4,997,218 A | | 3/1991 | Culling | |
| 5,584,333 A | | 12/1996 | Torchetti | |

(Continued)

*Primary Examiner* — K. Wong

(74) *Attorney, Agent, or Firm* — Kaspar Law Company, LLC; Scott R. Kaspar

(57) ABSTRACT

A system is disclosed for converting an overhead door into a gate or serving window, the system having at least two rows of panels spanning the width of the door, one panel located above and adjacent to the other panel, a pair of rails opposite one another and adjacent to the panels, the panels traveling within the rails to move from a closed position to an open position, and at least one hinge connecting the lower row of panels to the upper row of panels, the hinge having an upper half attached to the upper row of panels and a lower half attached to the lower row of panels, the upper and lower halves of the hinge connected by a removable central pin, wherein the upper row of panels moves from the closed position to the open position when the central pin is removed from the hinge.

20 Claims, 12 Drawing Sheets

(56) References Cited

U.S. PATENT DOCUMENTS

| | | | | |
|---|---|---|---|---|
| 5,611,382 | A | 3/1997 | Sferra | |
| 6,092,580 | A | 7/2000 | Lucas | |
| 6,315,027 | B1 * | 11/2001 | Lichy | E06B 3/485 160/205 |
| 7,234,502 | B2 * | 6/2007 | O'Malley | E05D 13/1261 49/200 |
| 7,726,378 | B1 * | 6/2010 | Savon | E06B 3/485 160/113 |
| 7,832,451 | B2 * | 11/2010 | Miller | E05D 15/24 160/113 |
| 9,303,683 | B1 * | 4/2016 | Newcomb, Jr. | E04B 1/34321 |
| 9,719,290 | B1 * | 8/2017 | Arroyo | E06B 3/485 |
| 9,957,753 | B2 | 5/2018 | Amsellem | |
| 2015/0330132 | A1 * | 11/2015 | Fraijo | E05D 15/242 16/382 |
| 2016/0265582 | A1 * | 9/2016 | Abdalla | F16C 11/045 |

* cited by examiner

SYSTEM AND METHOD FOR CONVERTING AN OVERHEAD DOOR INTO A GATE OR SERVING WINDOW TO FACILITATE ENTERTAINMENT AND OTHER PURPOSES

CROSS-REFERENCE TO RELATED APPLICATIONS

The present application claims the benefit of priority to U.S. Provisional Patent Application No. 62/844,043 filed May 6, 2019, and to U.S. Provisional Patent Application No. 62/911,921 filed Oct. 7, 2019, both of which are incorporated by reference herein in their entireties.

TECHNICAL FIELD

The present invention relates to overhead doors and, more particularly, to a system and method for modifying a standard overhead door to facilitate entertainment and other purposes. More specifically, the present invention relates to a novel system and method for converting an overhead door into a gate or serving window.

BACKGROUND

Overhead doors are well known in the art. Typically, overhead doors are comprised of a plurality of rows of panels spanning the width of the door opening, positioned between a pair of rails opposite one another in which the rows of panels travel along the rails from a closed or down position to an open or raised position.

Rows of panels typically are connected to one another via a plurality of hinges, each such hinge being permanently affixed to two adjacent rows of panels. In this manner, the plurality of rows of panels travel up the rails to move the entire door from the closed position to the open position.

To assist with the opening process of an overhead door, torsion springs mounted above the door often are used to help counter the weight of the door such that a person or low-horsepower motor can open the door. The torsion spring is sized and balanced based on the weight of the entire door, to serve as an effective counterbalance against the weight of the entire system. Often to balance the torsion spring, an installer might place the overhead door in a position approximately half-way between open and closed positions, and then increase tension on the torsion spring until the door suspends in half-way position on its own weight, balanced against the torsion spring.

Because the hinges tend to be permanently affixed to the panels, and because the torsion spring typically is sized and balanced against the weight of the entire door, the rows of panels of an overhead door typically travel together as one common linkage. Some prior art hinges exist that provide for a central pin to be removed, thereby decoupling one row of panels from an adjacent panel, as may be desirable to allow one row of panels to separate from the rest of the door. For example, U.S. Pat. No. 7,726,378 to Savon discloses an overhead door having hinges in which a pin can be pulled to decouple the bottom row of panels of the door such that the door may be opened to allow for ventilation while keeping a portion of the door closed to prevent animals and debris from entering the interior space. While the hinge disclosed by Savon could be placed on any row of panels, Savon focuses on decoupling only one row of panels, such that the weight of the door is not materially altered, thereby allowed the existing motor and torsion spring to operate the door as-is.

The prior art does not teach a comprehensive system for decoupling any row of panels, as necessary to form a gate or a serving window of any height, while simultaneously rebalancing the weight of the system to account for the changed dynamics of a partially-traveling door.

SUMMARY OF THE INVENTION

According to one non-limiting aspect of the present disclosure, an example embodiment of a system is disclosed for converting an overhead door into a gate or serving window. The system includes at least two rows of panels spanning the width of the door, one panel located above and adjacent to the other panel, a pair of rails opposite one another and adjacent to the panels, the panels traveling within the rails to move from a closed position to an open position, and at least one hinge connecting the lower row of panels to the upper row of panels, the hinge having an upper half attached to the upper row of panels and a lower half attached to the lower row of panels, the upper and lower halves of the hinge connected by a removable central pin, the lower half of the hinge having a spring-loaded pin for engaging with one of the rails to lock the lower row of panels to the rail, and the upper half of the hinge having an aperture for receiving and stowing the central pin upon removal, wherein the upper row of panels moves from the closed position to the open position when the central pin is removed from the hinge and the spring-loaded pin of the hinge is engaged with the rail.

According to another non-limiting aspect of the present disclosure, an example embodiment of a method is disclosed for converting an overhead door into a gate or serving window. The method includes the steps of providing at least two rows of panels spanning the width of the door, and locating one panel above and adjacent to the other panel; providing a pair of rails opposite one another and adjacent to the panels, the panels traveling within the rails to move from a closed position to an open position; providing at least one hinge connecting the lower row of panels to the upper row of panels, the hinge having an upper half attached to the upper row of panels and a lower half attached to the lower row of panels, the upper and lower halves of the hinge connected by a removable central pin, the lower half of the hinge having a spring-loaded pin for engaging with one of the rails to lock the lower row of panels to the rail, and the upper half of the hinge having an aperture for receiving and stowing the central pin upon removal; and moving the upper row of panels from the closed position to the open position when the central pin is removed from the hinge and the spring-loaded pin of the hinge is engaged with the rail, to form a serving window.

Additional features and advantages are described herein, and will be apparent from the following Detailed Description and the figures.

BRIEF DESCRIPTION OF THE DRAWINGS

Features and advantages of the system and method described herein may be better understood by reference to the accompanying drawings in which.

A skilled artisan will appreciate the foregoing details, as well as others, upon considering the following Detailed Description of certain non-limiting embodiments of the system and method according to the present disclosure. One of ordinary skill also may comprehend certain of such additional details upon using the system and method described herein.

DETAILED DESCRIPTION

The present disclosure, in part, is directed to overhead doors and, more particularly, to a system and method for modifying a standard overhead door to facilitate entertainment and other purposes. More specifically, the present invention relates to a novel system and method for converting an overhead door into a gate or serving window.

Figure 1A:
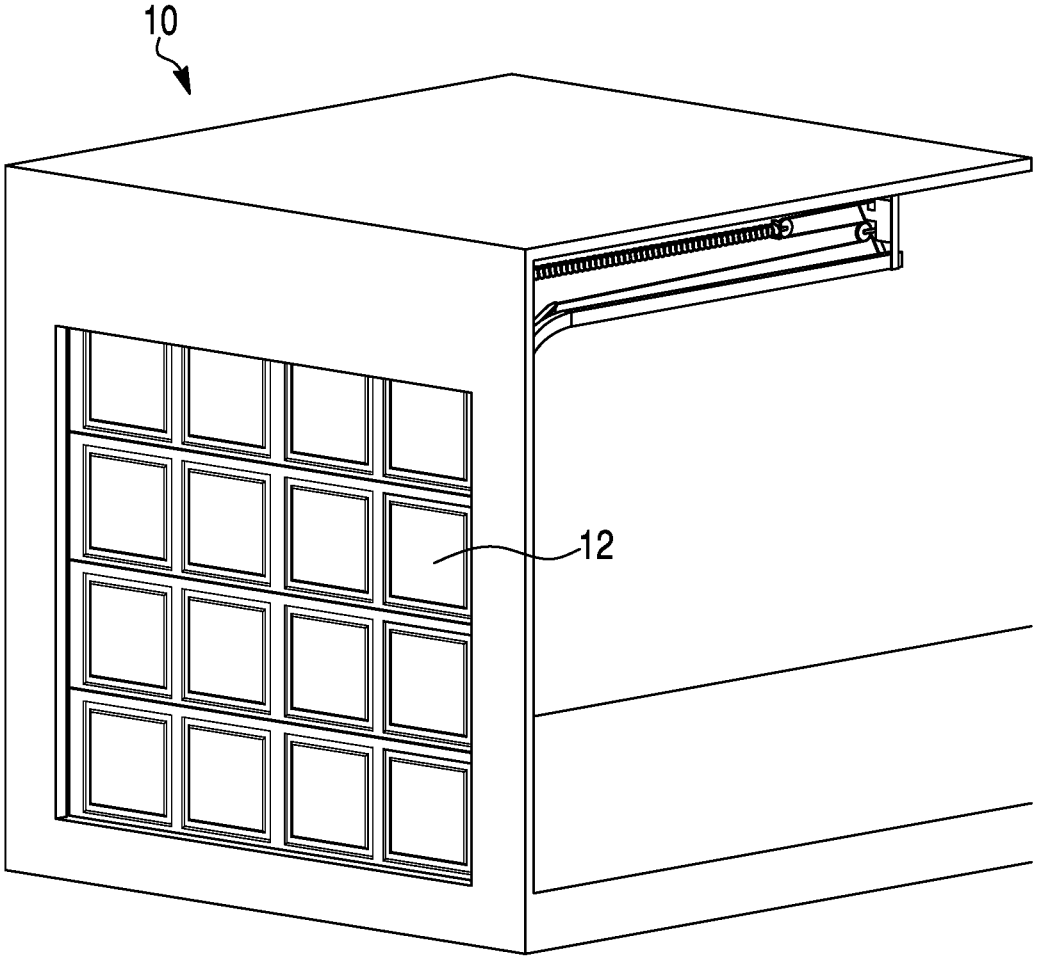
FIG. 1A depicts an exterior perspective view of an overhead door adapted for use with the system of the present disclosure when said door is positioned in a closed or down position.
Figure 1B:
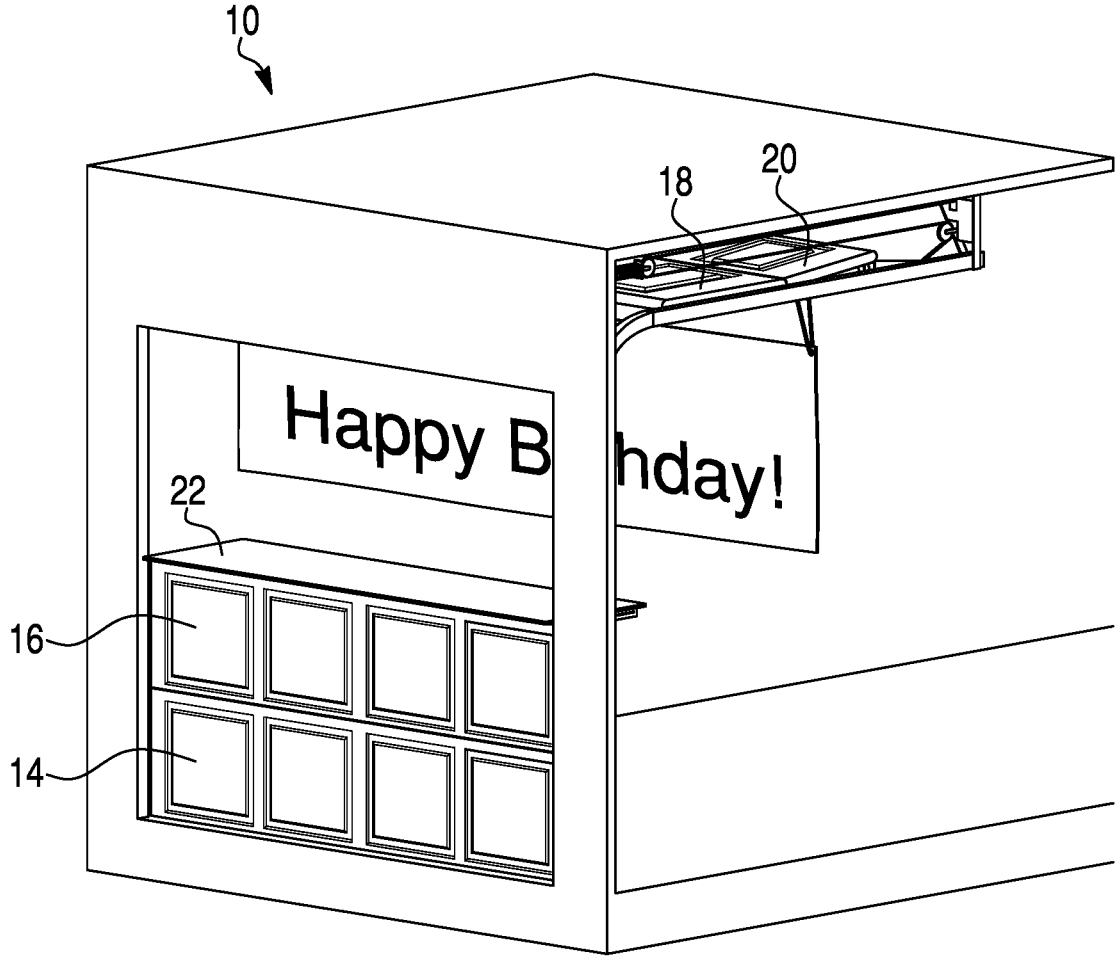
FIG. 1B depicts an exterior perspective view of the overhead door of FIG. 1A when a portion of said door is positioned in an open or raised position to reveal a serving window.

As shown in FIGS. 1A and 1B, an overhead door system 10 is shown having a door 12, which is comprised of a plurality of rows of panels 14, 16, 18, 20. While FIGS. 1A and 1B show four rows of panels, those of ordinary skill would appreciate that overhead doors may be comprised of more or less rows of panels, and panels may be wider or narrower than depicted in the figures. Typical overhead doors used in residential environments, such as for a garage door opening, often are comprised of four or five rows of adjoining and connected panels. The overhead door system 10 provides for a unique and novel method for separating one or more upper panels 18, 20 from one or more lower panels 14, 16, such that the lower panels can form a gate or, when coupled with a horizontal bench or countertop surface 22, a serving window as may be desirable for entertainment or other purposes.

Figure 2A:
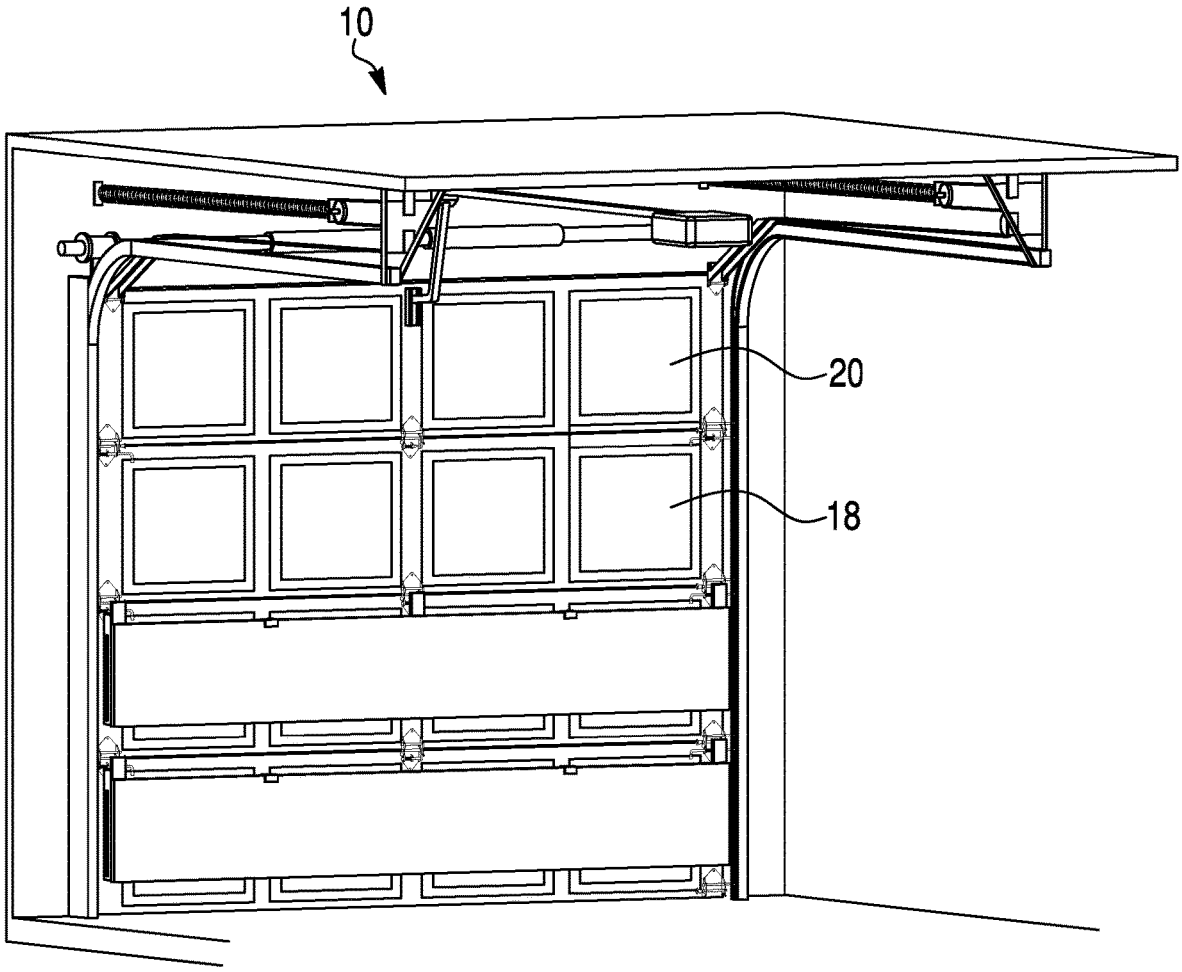
FIG. 2A depicts an interior perspective view of the overhead door of FIG. 1A.
Figure 2B:
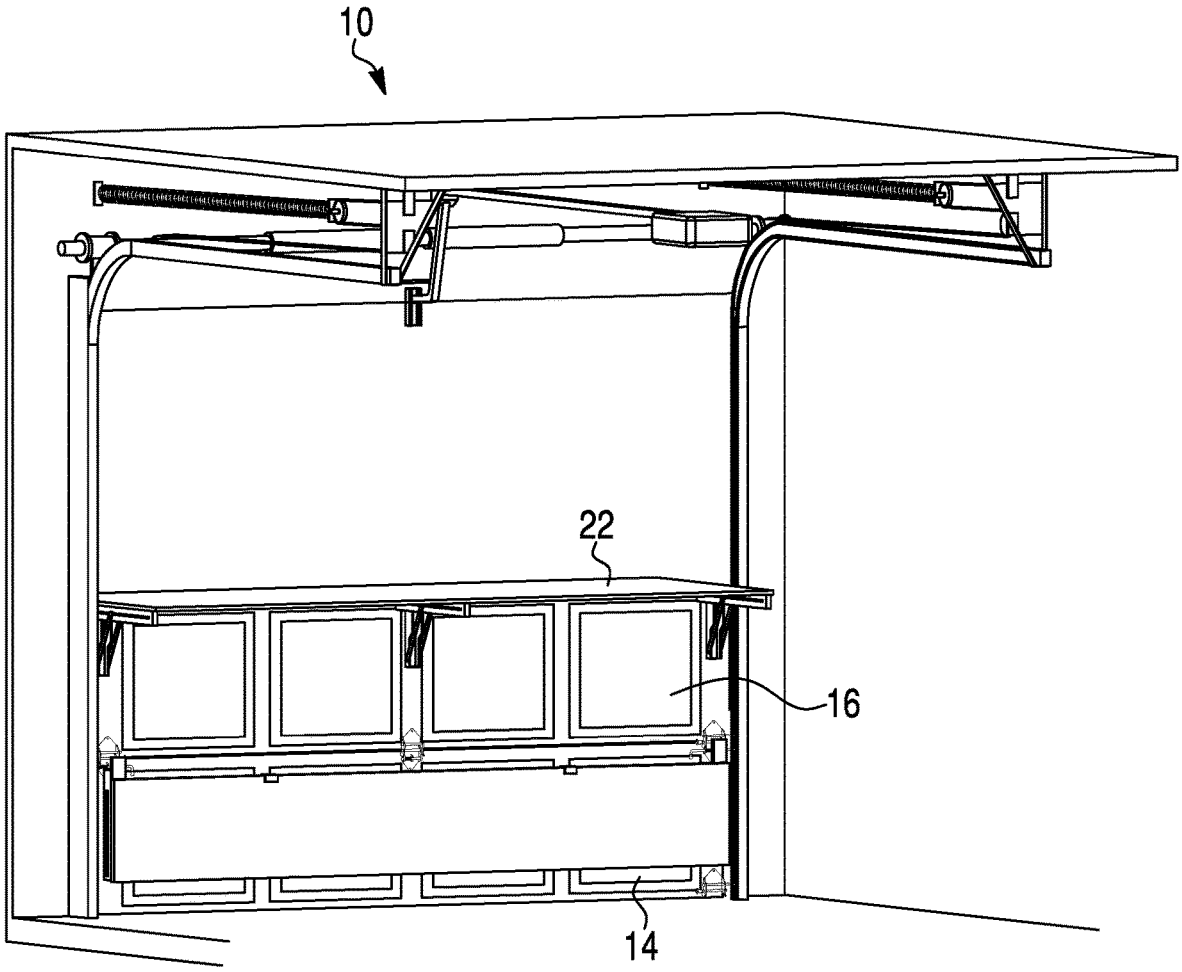
FIG. 2B depicts an interior perspective view of the overhead door of FIG. 1B.
Figure 6A:
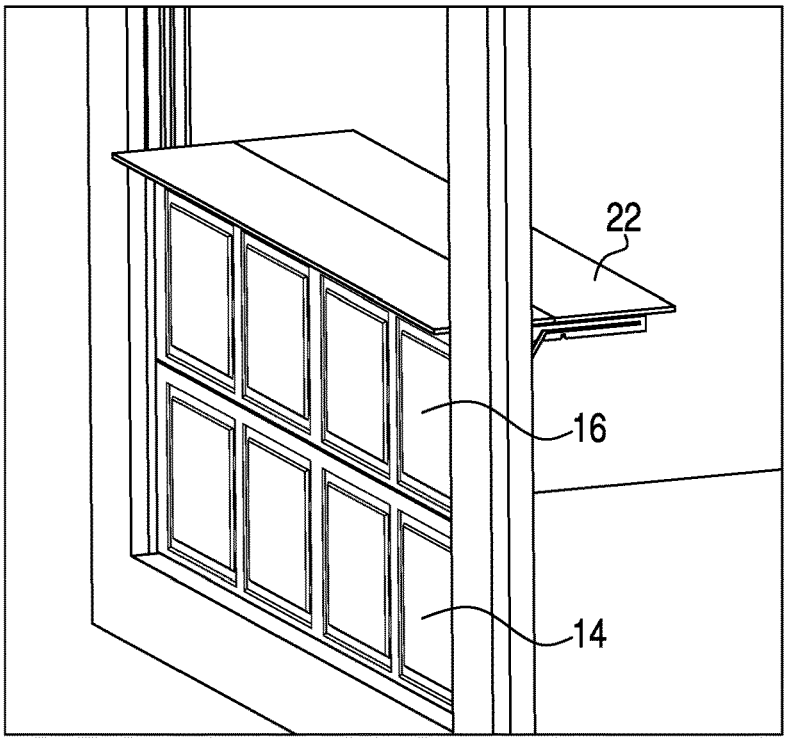
FIG. 6A depicts an exterior perspective view of the overhead door of the present disclosure when it has been converted for use as a serving window.
Figure 6B:
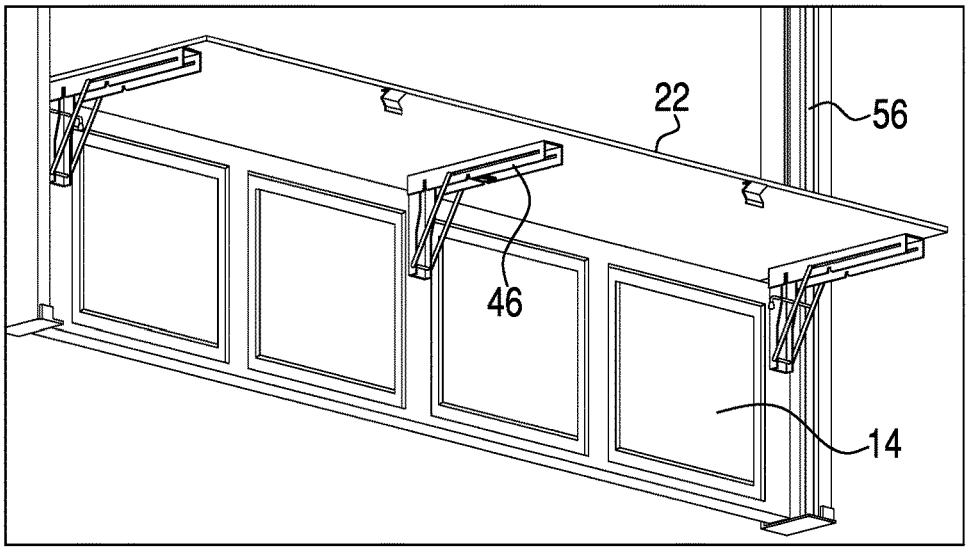
FIG. 6B depicts an interior perspective view of the overhead door of FIG. 6A.
Figure 6C:
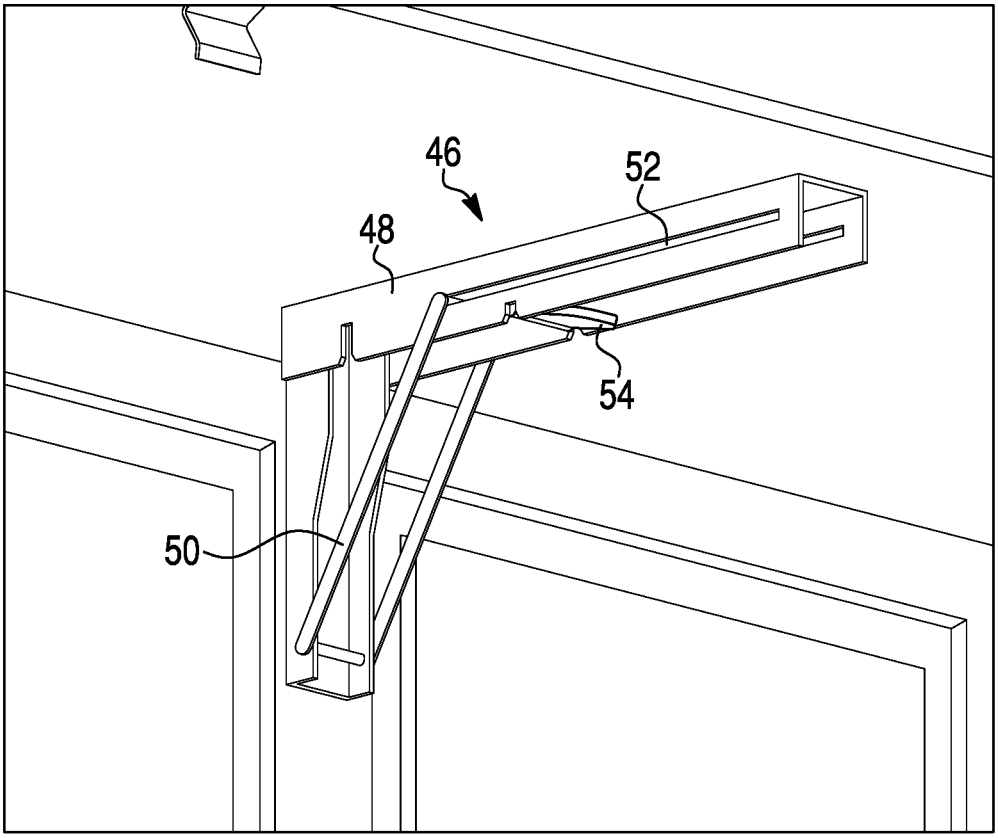
FIG. 6C depicts a close-up perspective view of the support hinge bracket assembly shown connected to the overhead door of FIG. 6B.

As shown in FIGS. 2A and 2B, the horizontal bench or countertop surface 22 may be configured to attach to any of the rows of panels and may be attached to the lowest panel 14 to facilitate a seating surface, as may be desirable for a spectator to sit while watching a driveway basketball game, as one example, or for a parent to sit while supervising children at play, as another example. The horizontal surface 22 may be attached to a higher panel, such as panel 16, to facilitate a countertop surface for supporting food or beverages, as may be desirable at an outdoor gathering or party, as one example, or to facilitate a bar or lemonade stand, as other examples. When not in use, the horizontal bench or countertop surface 22 may be stowed in a vertical position parallel with and adjacent to the panel to which it is attached, such that the overhead door 12 may be used in an ordinary manner without having to remove the bench or countertop surface 22, the details of which are shown in FIGS. 6A-6C and described hereinafter.

Figure 3:
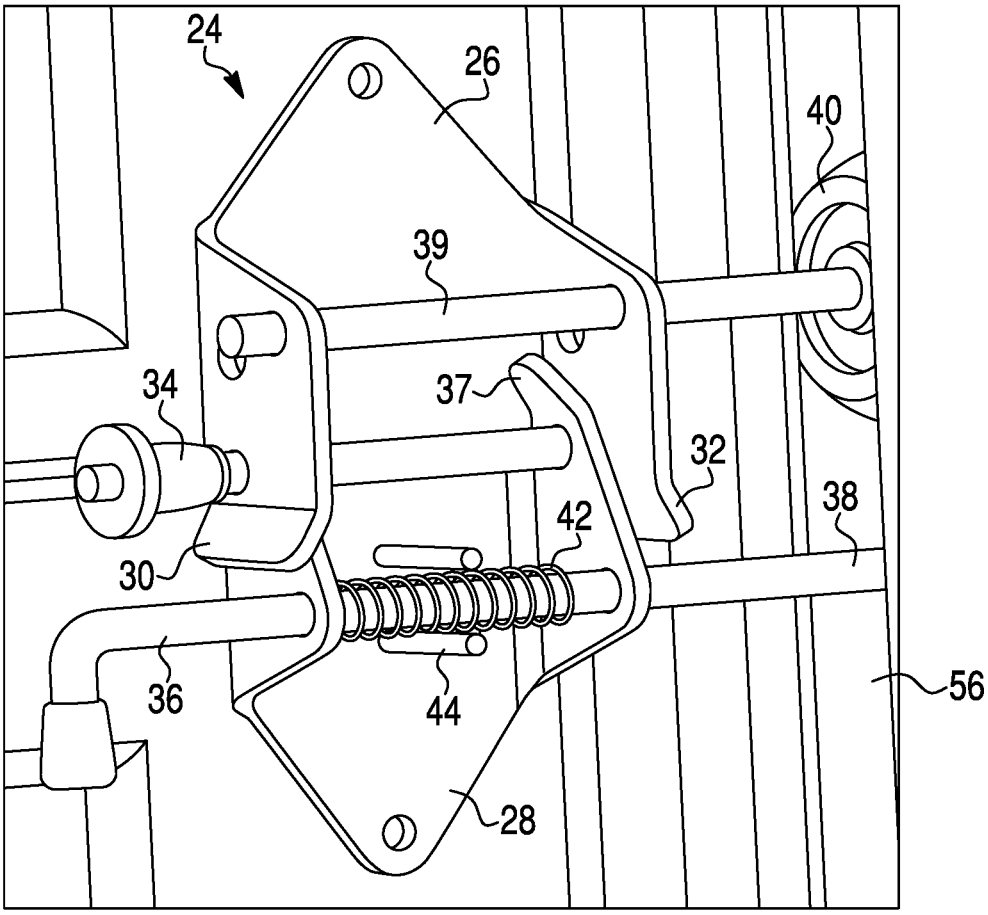
FIG. 3 depicts a split hinge assembly adapted for use with the system of the present disclosure.

The overhead door system 10 provides that one or more of the plurality of panels 14, 16, 18, 20 which comprise door 12 may separate to facilitate entertainment or other purposes. FIG. 3 shows a unique and novel split hinge assembly 24 that is one such example of accomplishing the efficient separation of the panels. Split hinge assembly 24 connects two panels and is mounted at the intersection of the panels. Split hinge assembly 24 is comprised of two halves, an upper half 26 and a lower half 28, and the upper half 26 is mounted to one panel while the lower half 28 is mounted to a lower panel. The upper 26 and lower 28 halves of split hinge assembly 24 are configured such that the lower half 28 slightly nests within the upper half 26. Specifically, the upper half 26 of split hinge assembly 24 includes flared mating portions 30, 32 which are bent outward to accept and receive lower half 28, which has retracted portions 37 to guide the upper half 26 over and around lower half 28 when the adjacent panels are adjoined together.

Split hinge assembly 24 further includes a panel lock spring pin 36, which passes through lower half 28 and terminates in a dowel pin 38 that travels within the rail 56. A second dowel pin 39 passes through upper half 26 and holds a wheel 40 that travels within the rail 56. Wheel 40 is a standard overhead door wheel that is sized to fit within the rail 56 and may be slightly smaller or slightly larger depending upon which panel the wheel is attached to. For example, overhead door manufacturers typically size and identify the wheels 40 by a numbering scheme such that the largest wheel, typically stamped with a "1," is located at the lowest panel, and wheels typically are numbered between 1-5 with higher-numbered wheels positioned with respect to higher-located panels. Panel lock spring 36 includes a spring 42 that is positioned within lower half 28 to actuate the spring pin from an unlocked position to a locked position.

Figure 4A:
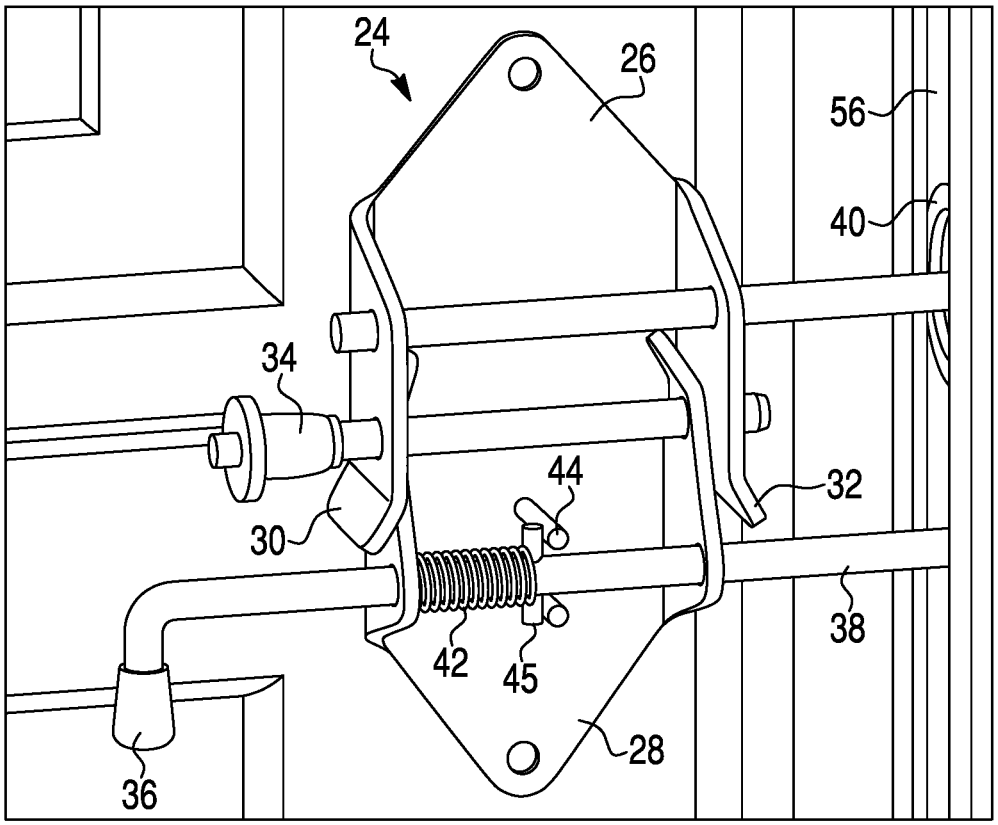
FIG. 4A depicts the split hinge assembly of FIG. 3 when it is being used in normal operation of the overhead door.

As shown in FIG. 4A, panel lock spring pin 36 is placed in an unlocked position during normal operation of the overhead door 12. In this configuration, the spring 42 is compressed between retaining member 45, which presses against post 44 of the lower half 28, and an inner edge of the lower half 28, thereby allowing pin 38 to travel freely within rail 56. Retaining member 45 may be a small retaining pin or set screw that passes through or otherwise attaches to pin 38 to securely retain spring 42. In the unlocked position, retaining member 45 rests against post 44, which protrudes from lower half 28. Alternatively, post 44 may be an enclosure that surrounds or encloses the pin 38, with retaining member 45 passing through the enclosure when pin 38 is rotated ninety degrees but prevented from passing through when the pin is in the default or unlocked position, similar to a keyhole, which permits entry of the key (pin) in one orientation only but restricts entry in any other orientation.

Figure 4B:
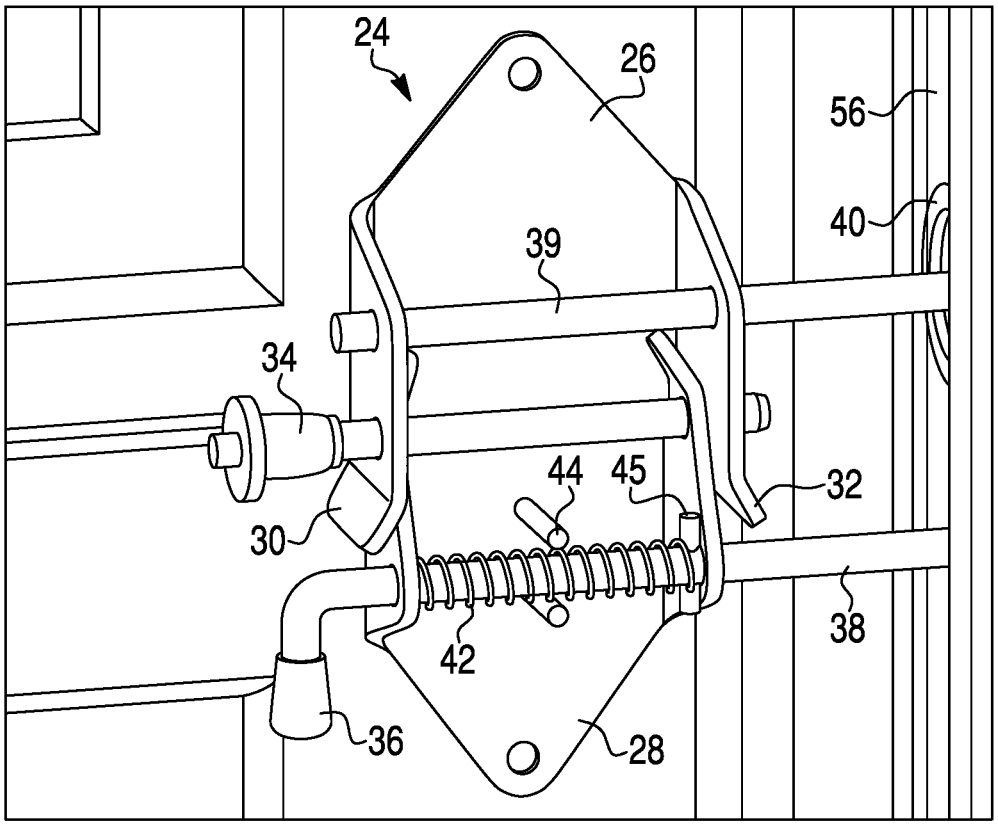
FIG. 4B depicts the split hinge assembly of FIG. 4A when it has been placed into a locked position.

When desiring to separate one of more of the panels 14, 16, 18, 20 of the overhead door 20, the lower panels remaining in a closed position preferably are locked to prevent movement of those lower panels. As shown in FIG. 4B, the panel lock spring pin 36 may be placed into a locked position in which the pin 38 engages and locks with the rail 56, such as by passing through an aperture cut within rail 56. To move the panel lock spring pin 36 into the locked position, the panel lock spring pin 36 must be rotated by about ninety degrees to allow the retaining member 45 to disengage from the post 44 and allow the retaining member 45 to move past the post 44, thereby allowing spring 42 to expand and fill the entire cavity within the lower half 28. The expansion of the spring 42 maintains the panel lock spring pin 36 in a locked position.

Figure 5A:
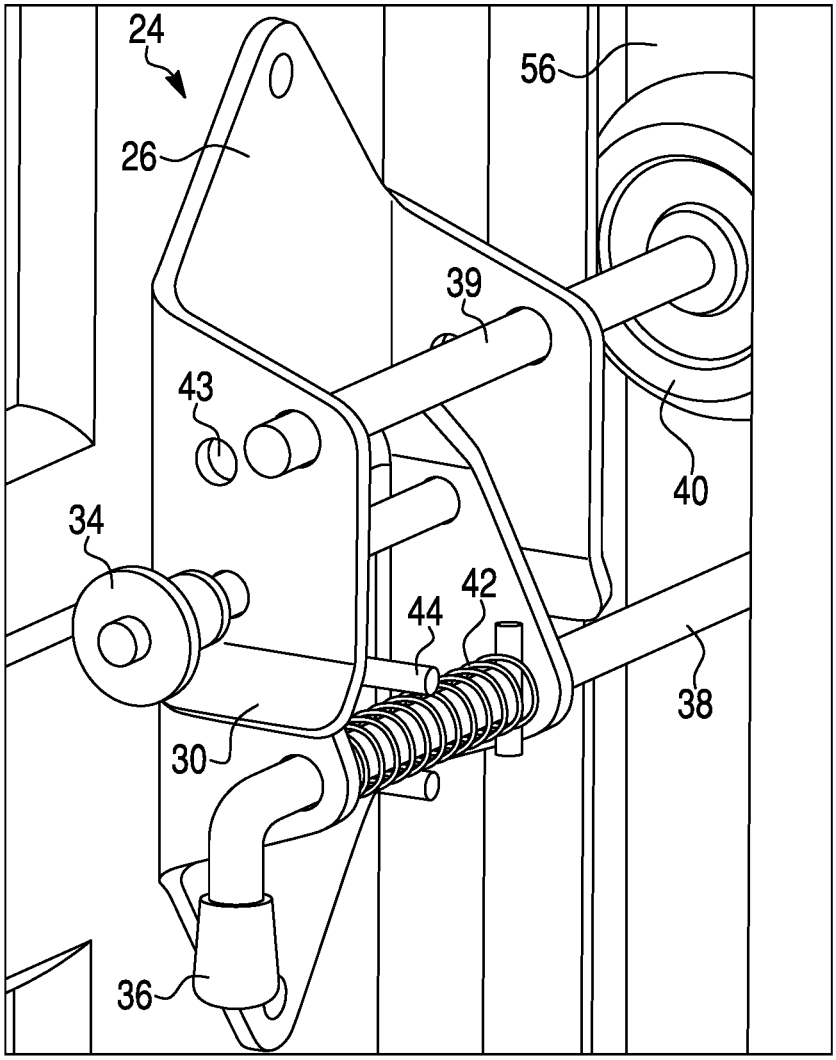
FIG. 5A depicts the split hinge assembly of FIG. 4B when the hinge pin is being removed.
Figure 5B:
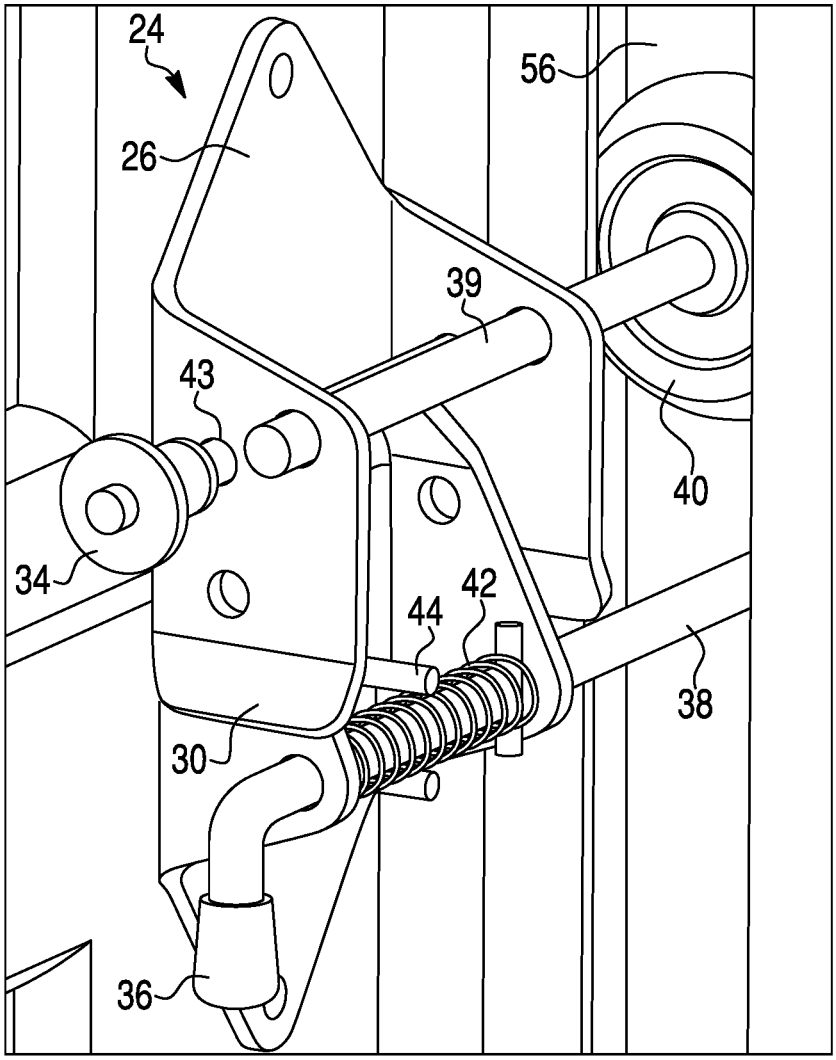
FIG. 5B depicts the split hinge assembly of FIG. 5A when the removed hinge pin has been stowed.

With the lower panels placed in a locked position with respect to the rail 56, the upper half 26 of the split hinge assembly 24 may be disconnected from the lower half 28 to allow upper panels to move up rail 56 to the open position, thereby creating the serving window, for instance. As shown in FIG. 5A, central pin 34 may be removed from the split hinge assembly 24 such that the upper half 26 disconnects from lower half 28, thereby allowing upper half 26 to move upward and away from lower half 28 as the panels are separated. Central pin 34 preferably is a locked pin that engages and is locked within split hinge assembly 24 when the upper 26 and lower 28 halves are joined, such as by a threaded connection, press-fit connection, or similar to lock the central pin 34 within the split hinge assembly 24. As shown in FIG. 5B, the central pin 34 may be stored within an aperture 43 within or inside of dowel pin 39.

To utilize the lower panels 14, 16 as a serving window, once the lower panels are secured and locked to the rail 56, the horizontal bench or countertop surface 22 may be moved from a stowed position to a horizontal position, as shown in FIGS. 6A and 6B. This is accomplished by use of a retractable bracket hinge 46, which either attaches to or is used in place of lower half 28 of the split hinge assembly 24.

As shown in FIG. 6C, hinge bracket 46 is comprised of a cantilever support member 48 that is maintained in a horizontal position by lower support member 50, which is affixed to and travels within a slot 52 disposed within cantilever support member 48. This configuration allows cantilever support member 48 to move from a horizontal position, as shown in FIG. 6C, to a vertical position, as shown in FIG. 2A, by allowing the lower support member 50 to slide about the slot 52. Release lever 54 locks lower support member 50 within slot 52 to hold cantilever support member 48 in the horizontal position during use or to lock cantilever support member 48 in a stowed position, as shown in FIG. 2B.

Overhead doors typically have pulleys 58 that wind a cable attached to the bottom panel of the door and are wound to assist movement of the door by a torsion spring centrally located above the door. Torsion springs are set to counter the entire weight of the door and only provide assistance when the entire door moves, because the cable wound by a torsion spring is attached to the lowest panel. When upper panels are separated from lower panels, the upper panels no longer would be assisted by the torsion spring when the panels are moved to the open position. Because panels tend to be heavy, this weight could place undue stress on a user, resulting in injury, or on a motor unit, resulting in damage to the motor or inability of the motor to move the upper panels.

Figure 7A:
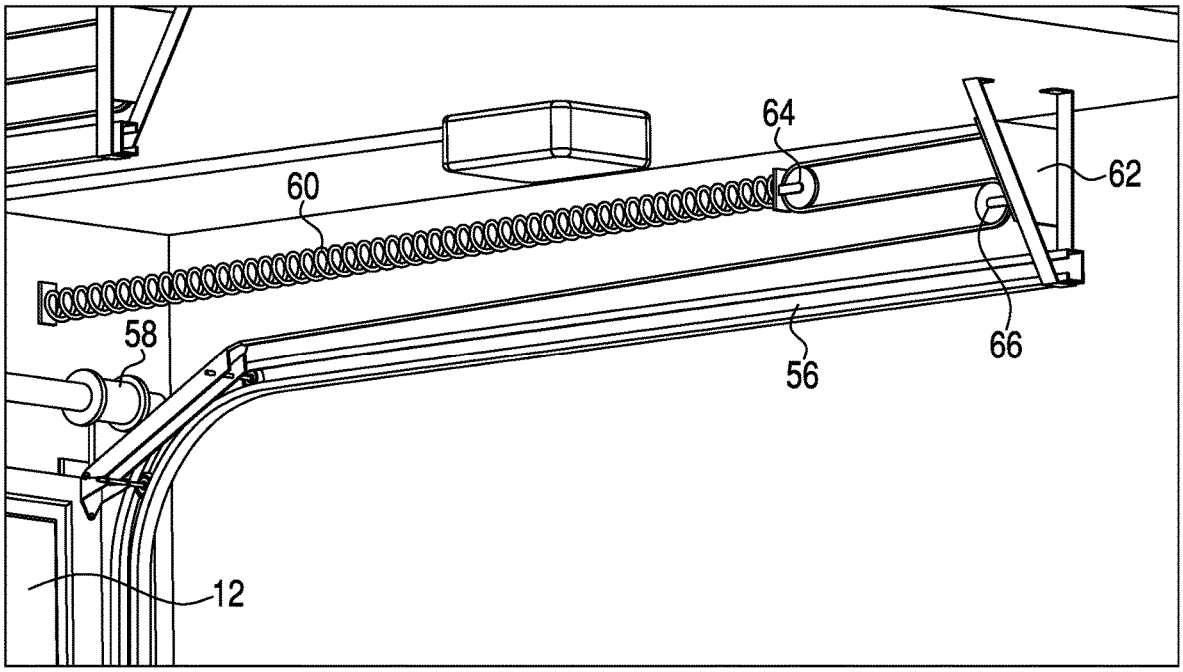
FIG. 7A depicts an interior perspective view of a rail and extension spring assist components adapted for use with the with the system of the present disclosure.
Figure 7B:
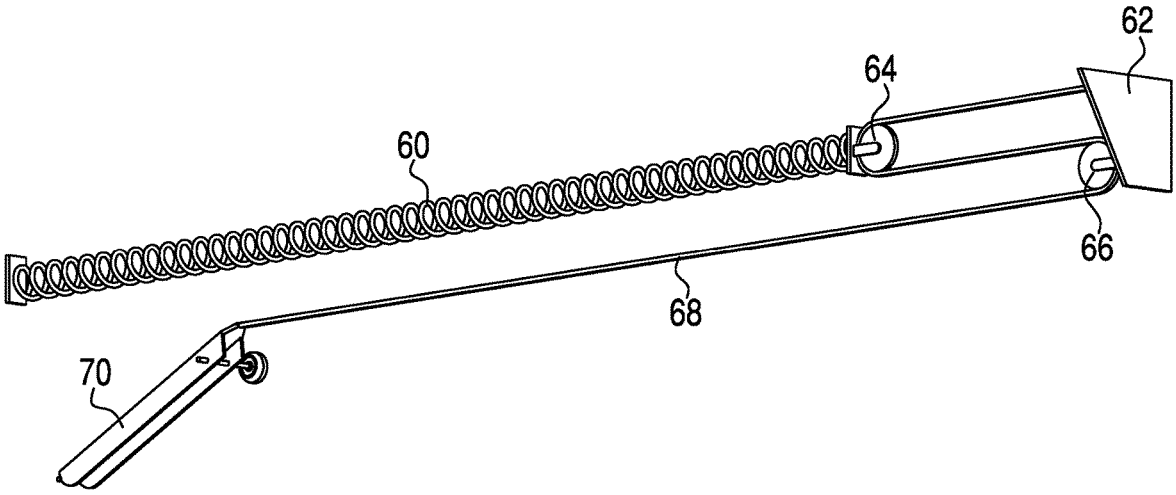
FIG. 7B depicts the extension spring assist components shown in FIG. 7A.

As shown in FIGS. 7A and 7B, novel extension spring assist components are disclosed which work to pull the upper panels from the top. Specifically, extension spring 60, which is mounted against a front wall, pulls a cable 68 that is attached to plate 62 mounted to the ceiling struts supporting rail 56. Cable 68 passes around pulleys 64, 66 attaches to upper panel pull roller bracket 70. FIG. 7A shows the extension spring assist components as positioned when the upper panels are in the closed position, with the extension spring 60 in an extended position. As the upper panels move to the open position, the extension spring 60 retracts to a resting position.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended set of claims.

What is claimed is:

1. A system for converting an overhead door into a serving window, the system comprising:

at least two rows of panels spanning the width of the door, one panel located above and adjacent to the other panel;

a pair of rails opposite one another and adjacent to the panels, the panels traveling within the rails to move from a closed position to an open position;

at least one hinge connecting the lower row of panels to the upper row of panels, the hinge having an upper half attached to the upper row of panels and a lower half attached to the lower row of panels;

the upper half of the hinge having opposite sides with flared mating portions that are turned outwardly, and the lower half of the hinge having opposite sides with flared mating portions that are turned inwardly, such that the lower half of the hinge fits within the upper half of the hinge, the flared mating portions of the lower hinge nesting within the flared mating portions of the upper hinge;

a first pin passing through the mating portions of the upper and lower halves of the hinge when the lower half of the hinge is nested within the upper half of the hinge, the pin locking the upper and lower halves of the hinge together;

an aperture in the upper half of the hinge for receiving and stowing the first pin when the first pin is removed from the mating portions of the upper and lower halves of the hinge to unlock the upper half from the lower half of the hinge;

a second pin passing through a portion of the lower hinge located proximately beneath the first pin when inserted into the upper and lower halves of the hinge, the second pin configured to engage with one of the rails to lock the lower row of panels to the rail;

wherein the upper row of panels moves from the closed position to the open position when the first pin is removed from the hinge and the second pin of the hinge is engaged with the rail.

2. The system of claim 1 wherein the lower half of the hinge has a cantilever support member that moves from a stowed vertical position to a horizontal position flush with the top of the lower row of panels.

3. The system of claim 2 further comprising a countertop attached to the cantilever support member, the countertop forming a horizontal surface on top of the lower row of panels when the cantilever support member is placed in the horizontal position.

4. The system of claim 2 wherein the cantilever support member is braced by a lower support member attached to the lower half of the hinge, the lower support member slidably connected to the cantilever support member and lockable in upright and in stowed positions.

5. The system of claim 1 further comprising an extension spring system to assist the upper row of panels to move from closed to open positions.

6. The system of claim 5 wherein the extension spring system comprises an extension spring, one end of which is operatively connected to a mounting surface disposed above the overhead door and the opposite end of the extension spring of which is operatively connected to an upper edge of the upper row of panels.

7. The system of claim 6 wherein the extension spring is operatively connected to the upper row of panels via a cable running over one or more pulleys.

8. The system of claim 1 further comprising at least one intermediary row of panels positioned between the upper and lower row of panels, the intermediary row of panels having at least one hinge connecting the lower and intermediary row of panels and at least one hinge connected the upper and intermediary row of panels.

9. The system of claim 8 wherein the lower half of the hinge attached to the upper edge of the intermediary row of panels has a cantilever support member that moves from a stowed vertical position to a horizontal position flush with the top of the intermediary row of panels, and wherein a countertop surface is attached to the cantilever support member to create a horizontal countertop surface on top of the intermediary row of panels when the cantilever support member is in the horizontal position.

10. The system of claim 1 further comprising a banner operatively connected to the upper row of panels, the banner suspending downward and behind the lower row of panels when the upper row of panels is in the open position.

11. A method for converting an overhead door into a serving window, the method comprising the steps of:

providing at least two rows of panels spanning the width of the door, and locating one panel above and adjacent to the other panel;

providing a pair of rails opposite one another and adjacent to the panels, the panels traveling within the rails to move from a closed position to an open position;

providing at least one hinge connecting the lower row of panels to the upper row of panels, the hinge having an upper half attached to the upper row of panels and a lower half attached to the lower row of panels; and providing the upper half of the hinge with flared mating portions that are turned outwardly;

providing the lower half of the hinge with flared mating portions that are turned inwardly, such that the lower half of the hinge fits within the upper half of the hinge, the flared mating portions of the lower hinge nesting within the flared mating portions of the upper hinge;

providing a first pin passing through the mating portions of the upper and lower halves of the hinge when the lower half of the hinge is nested within the upper half of the hinge, the pin locking the upper and lower halves of the hinge together;

providing an aperture in the upper half of the hinge for receiving and stowing the first pin when the first pin is removed from the mating portions of the upper and lower halves of the hinge to unlock the upper half from the lower half of the hinge;

providing a second pin passing through a portion of the lower hinge located proximately beneath the first pin when inserted into the upper and lower halves of the hinge, the second pin configured to engage with one of the rails to lock the lower row of panels to the rail;

moving the upper row of panels from the closed position to the open position when the first pin is removed from the hinge and the second pin of the hinge is engaged with the rail, to form a serving window.

12. The method of claim 11 wherein the lower half of the hinge has a cantilever support member that moves from a stowed vertical position to a horizontal position flush with the top of the lower row of panels.

13. The method of claim 12 further comprising the step of providing a countertop surface attached to the cantilever support member, the countertop forming a horizontal surface on top of the lower row of panels when the cantilever support member is placed in the horizontal position.

14. The method of claim 12 wherein the cantilever support member is braced by a lower support member attached to the lower half of the hinge, the lower support member slidably connected to the cantilever support member and lockable in upright and in stowed positions.

15. The method of claim 11 further comprising the step of providing an extension spring system to assist the upper row of panels to move from closed to open positions.

16. The method of claim 15 wherein the extension spring system comprises an extension spring, one end of which is operatively connected to a mounting surface disposed above the overhead door and the opposite end of the extension spring of which is operatively connected to an upper edge of the upper row of panels.

17. The method of claim 16 wherein the extension spring is operatively connected to the upper row of panels via a cable running over one or more pulleys.

18. The method of claim 11 further comprising the step of providing at least one intermediary row of panels positioned between the upper and lower row of panels, the intermediary row of panels having at least one hinge connecting the lower and intermediary row of panels and at least one hinge connected the upper and intermediary row of panels.

19. The method of claim 18 wherein the lower half of the hinge attached to the upper edge of the intermediary row of panels has a cantilever support member that moves from a stowed vertical position to a horizontal position flush with the top of the intermediary row of panels, and wherein a countertop surface is attached to the cantilever support member to create a horizontal countertop surface on top of the intermediary row of panels when the cantilever support member is in the horizontal position.

20. The method of claim 11 further comprising the step of providing a banner operatively connected to the upper row of panels, the banner suspending downward and behind the lower row of panels when the upper row of panels is in the open position.

* * * * *